United States Patent [19]

Shimizu

[11] 4,355,667

[45] Oct. 26, 1982

[54] HEDDLE FRAME

[75] Inventor: Yoichi Shimizu, Izumishi, Japan

[73] Assignee: Kabushiki Kaisha Maruyama Seisakusho, Sakaishi, Japan

[21] Appl. No.: 158,352

[22] Filed: Jun. 11, 1980

[30] Foreign Application Priority Data

Sep. 3, 1979 [JP] Japan ..... 54-120467

[51] Int. Cl.[3] ..... D03C 9/06

[52] U.S. Cl. ..... 139/91

[58] Field of Search ..... 139/91, 92

[56] References Cited

U.S. PATENT DOCUMENTS 3,335,759 8/1967 Koch ..... 139/91

4,015,639 4/1977 Koch ..... 139/92

4,275,772 6/1981 Shimizu .

FOREIGN PATENT DOCUMENTS 925562 5/1963 United Kingdom ..... 139/91

*Primary Examiner*—Henry Jaudon

*Attorney, Agent, or Firm*—Oblon, Fisher, Spivak, McClelland & Maier

[57] ABSTRACT

A heddle frame usable in a high speed loom is disclosed. The heddle frame includes hollow horizontal aluminum bars joined to vertical side stays. Each joint consists of a receptacle in an end of an aluminum bar, including a channel section into which an extension of a connecting piece held within a side stay may be inserted for joining the aluminum bar and side stay. A fixing bolt passes through the connecting piece and is threaded into a bore of the receptacle.

4 Claims, 6 Drawing Figures

HEDDLE FRAME

BACKGROUND OF THE INVENTION

1. Field of the Invention

The present invention relates to a heddle frame improved in the joining structure of an aluminum bar and a side stay.

2. Description of the Prior Art

FIG. 1 is a partly abbreviated side view of a heddle frame of the prior art used in conventional looms, in which 1' depicts a pair of aluminum bars, of which one end of each bar is fixed with side stay 2' to form a frame. Numeral 3' depicts a heddle rod which is horizontally suspended to the side stay 2', and stretches a number of heddles 4'. The heddle rod 3 is supported by middle hooks 5' at certain spaced intervals, and the middle hooks 5' are supported by hook hangers 6' engaging in the support groove 7' at the lower end of the aluminum bar 1'.

Further, numeral 8' depicts a guide plate for guiding the motion of the aluminum bar 1'.

In the prior art heddle frame described above, the joint structure of the A and A' portion which connects aluminum bar 1' and side stay 2' is required to possess more joining strength as the speed of the loom is raised. By increasing the strength of the joint of aluminum bar 1' and side stay 2', however, the joint structure becomes complicated, requiring difficult assembly and disassembly operations, as well as increasing the inertia force which accompanies shedding. This results in such disadvantages as failure of the joining portion of the aluminum bar 1' and side stay 2' due to the deflection of aluminum bar 1', and excessive wear of the driving system or excessive noise as the weight of the frame increases. Various arrangements of the joining portion A and A' have been devised, however, no satisfactory fixing structure has yet been devised.

SUMMARY OF THE INVENTION

It is the object of the present invention to overcome the above disadvantage of the prior art. Accordingly, there has been adopted a special receptacle and connecting piece to join the aluminum bar and side stay, for the purpose to offer a very convenient and practical heddle frame with simple assembling construction allowing easy assembly or disassembly of the side stay to the aluminum bar. The heddle frame is being made to have relatively light weight, high rigidity and fully meet with the requirements of high speed operation.

BRIEF DESCRIPTION OF THE DRAWINGS

Various other objects, features and attendant advantages of the present invention will be more fully appreciated as the same becomes better understood from the following detailed description when considered in connection with the accompanying drawings and wherein like reference characters designate like or corresponding parts throughout the several views, and wherein.

DETAILED DESCRIPTION OF THE PREFERRED EMBODIMENTS

Figure 1:
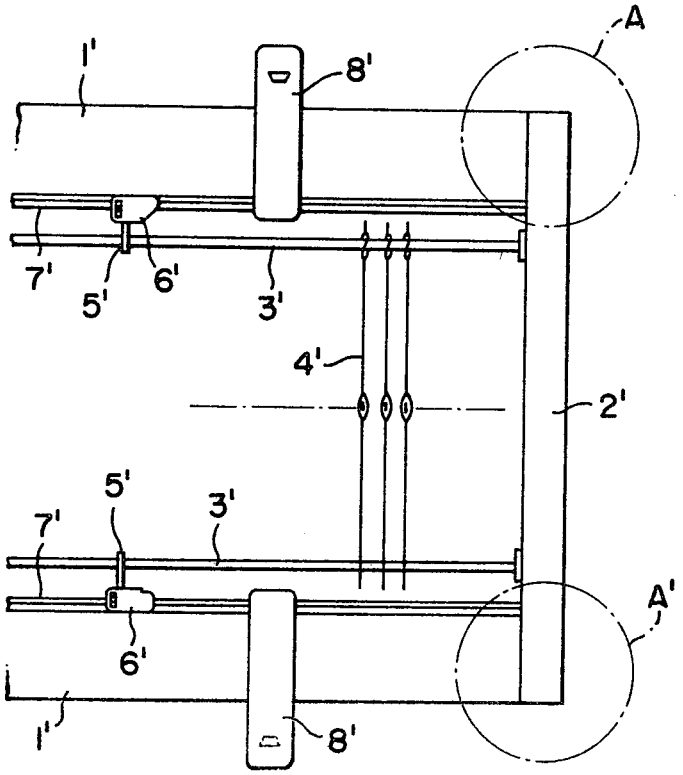
FIG. 1 is a partial side view of a prior art heddle frame.
Figure 2:
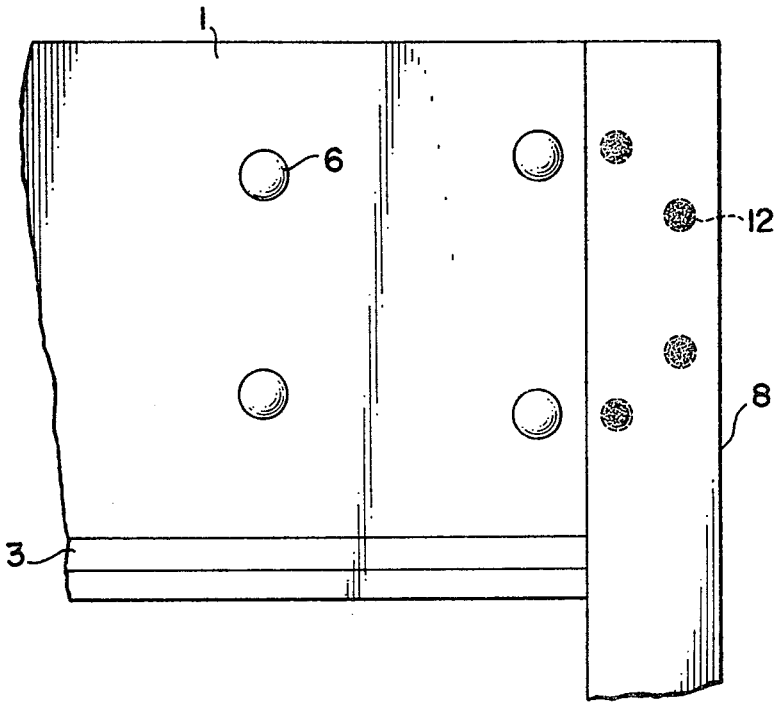
FIG. 2 is a side view of the heddle frame of this invention corresponding to the A portion of FIG. 1.
Figure 3:
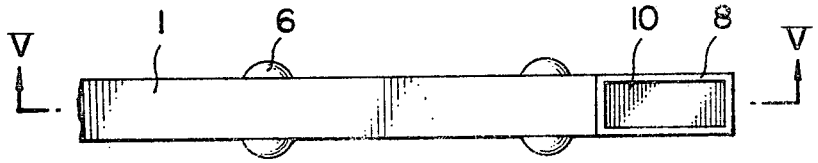
FIG. 3 is a plan view of FIG. 2.
Figure 6:
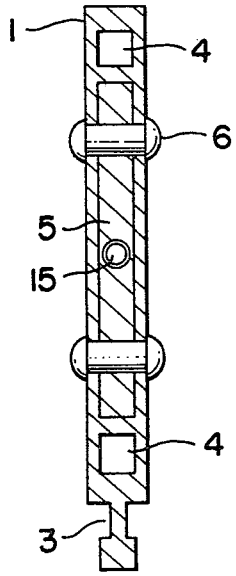
FIG. 6 is a sectional view taken on line VI—VI of FIG. 5.

In the drawing, numeral 1 is an aluminum bar, in which a hollow portion 2 is formed, and fitting grooves 3 are formed in the lower part to fix hook hangers. Numeral 4 depicts a hollow portion formed to further reduce the weight of the aluminum bar, as does the hollow portion 2.

Figure 5:
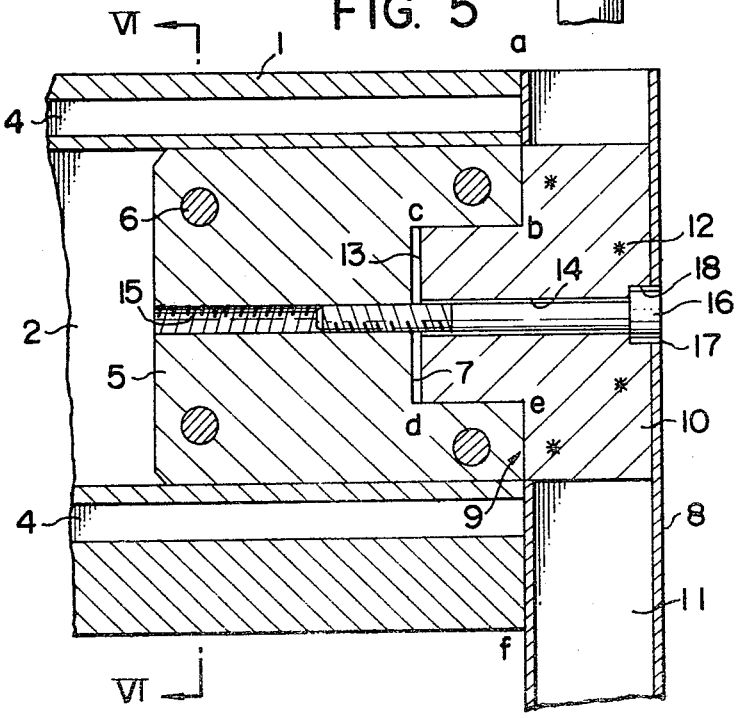
FIG. 5 is a sectional view taken on line V—V of FIG. 3.

Numeral 5 depicts a receptacle which is fitted in the hollow portion 2 at the end of the aluminum bar 1 and is securely fastened to the aluminum bar 1 with rivets 6. The end of the receptacle is inserted into the aluminum bar 1 so as to make its end flush with the end face of the aluminum bar 1, and a fitting groove 7 is cut in the end center of the receptacle 5 to form a channel form opening to the outside as shown in FIG. 5.

Numeral 8 depicts a hollow side stay to be connected to the end of the aluminum bar, and is formed of a hollow square pipe, formed with an opening 9 in the side facing the end face of the aluminum bar 1.

Numeral 10 is a connecting piece inserted from the opening 9 and fitted in the hollow portion 11 of the side stay 8. The connecting piece 10 is securely fixed to the side stay 8 with spot welds 12 or rivets. Further, numeral 13 depicts a projecting piece horizontally projected from the connecting piece 10 towards the end side of the aluminum bar 1, and arranged such that the fitting groove 7 formed in the receptacle 5 and the projecting piece 13 of the connecting piece 10 can be mutually fitted together.

Numeral 14 depicts a bolt hole formed in the connecting piece 10. The bolt hole 14 extends horizontally through the center portion of the projecting piece 13 of the connecting piece 10.

Numeral 15 depicts a threaded hole formed in the receptacle 5, and extended to the bottom face of the fitting groove 7 so that the threaded hole connects with the bolt hole 14 formed in the connecting piece 10.

Numeral 16 depicts a clamping bolt, which is inserted through the bolt hole 14 of the connecting piece 10 from a hole 17 formed in the outer face of the side stay 8, and threaded so that the threaded end portion of the bolt can screw into the threaded hole 15 formed in the receptacle 5, so as to connect the side stay 8 securely to the end of the aluminum bar 1.

Figure 4:
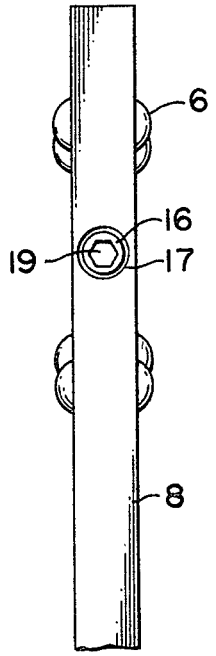
FIG. 4 is a right end view of FIG. 2.

The head of the clamping bolt 16 is sized so that it can be immersed into the spot facing hole 18; however, the head of the clamping bolt 16 is formed with a hexagonal socket hole 19 as shown in the FIG. 4, thereby allowing one to fasten the bolt even when the top of the head of the clamping bolt 16 is completely immersed in the spot facing hole 18.

Although the structure shown in FIG. 2 through FIG. 6 corresponds to the portion A shown in FIG. 1, the portion A' is similarly constructed.

To assemble the heddle frame according to the above embodiment of this invention, it is only necessary to attach the side stay to the end face of the horizontal aluminum bar 1, so that the projecting piece 13 of the connecting piece 10 fits in the fitting groove 7 of the receptacle 5. Then, when the projecting piece 13 is fitted in the fitting groove 7, the bolt hole 14 formed in the connecting piece 10 is automatically located so as to connect with the thread hole 15 in the receptacle 5. Therefore, the clamping bolt 16, which is inserted from the hole 17 of the side stay 8, can be inserted smoothly into the threaded hole 15 from the bolt hole 14, and the connecting piece 10 and the receptacle 5 can be fixedly fitted together with the projecting piece 13 and the fitting groove 7 as shown in FIG. 5, by screwing the threaded portion of the bolt 16 in the threaded hole 15 and tightening, so that the side stay 8 becomes securely fixed to the end of the aluminum bar 1.

To remove the side stay 8 from the end face of the aluminum bar 1 for the purpose of repair or maintenance inspection of the heddle frame, it is only necessary to pull the side stay 8 horizontally after the clamping bolt 16 is loosened and pulled out. The aluminum bar 1 and the side stay 8 are thus separated, with a-b-c-d-e-f of FIG. 5 as the border plane.

Although in the above embodiment, the fitting surface of the projecting piece 13 and the fitting groove 7, c-b and d-e, are made parallel as shown in FIG. 5, a small taper or gradient may be given to the mating surfaces c-b and d-e to make insertion or pulling out of the projecting piece 13 to the fitting groove 7 easier and more convenient.

Although, in this embodiment, only one clamping bolt 16 is adopted, another embodiment employing plural clamping bolts 16 to clamp and secure the connection of receptacle 5 and connecting piece 10 is also possible and thus can raise the connecting strength of the aluminum bar 1 and the side stay 8 further.

Because of the construction and function of the embodiment of the present invention as stated above, and because the receptacle and connecting piece are each fitted to the aluminum bar or side stay and fixed rigidly, repetitive assembly and disassembly of the side stay will not cause any looseness and the structure is sufficiently strong to bear long term service. The attaching and removing of the side stay is very simple and completed in a short time, because it can be accomplished by only attaching or pulling out the side stay horizontally to or from the end face of the aluminum bar and screw tightening or loosening the clamping bolt.

Further, because the projecting piece of the connecting piece is fitted in the fitting groove and then screw tightened by a clamping bolt passing through the fitted portion to make them one united body, the connecting strength of the aluminum bar and the side stay is quite high and the rigidity of the frame is also very high. Further, the construction of the aluminum bar and the side stay which have hollow parts, and the small receptacle and joining piece which are fitted to a part of the hollow portion and fixed, serve to make the heddle frame light in weight as well as allowing the adoption of a relatively larger modulus of elasticity for the aluminum bar and side stay and resulting in many advantages such as stong bending strength and sufficient durability for high speed operation and heavy load operation. The present invention allows a practical and convenient heddle frame which is far more functional in comparison with conventional ones, and allows manufacture at a low cost.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a heddle frame having at least one hollow horizontal aluminum bar and at least one hollow side stay, a joint connecting one end of one said at least one aluminum bar and one said at least one side stay, said joint comprising:

a receptacle fixedly fitted into the hollow of said one aluminum bar at said one end of said one aluminum bar with one face of said receptacle flush with said one end, said one face defining a channel section, and a fixing bore extending into said receptacle from said channel section in the longitudinal direction of said aluminum bar;

a connecting piece fixedly fitted into the hollow of said side stay and having one face flush with a surface of said side stay, said one face of said connecting piece including a projecting portion adapted to mate with said channel section whereby said one face of said receptacle and said one face of said connecting piece mate with one another, said connecting piece also including a second bore extending therethrough from said projecting portion, said second bore being in alignment with said fixing bore when said channel section and said projecting portion are mated to one another; and fixing means connected between said bores and fixing said projecting portion in mating relation with said channel section whereby said aluminum bar and said side stay are joined, whereby the strength of said joint may be increased without increasing the size of said aluminum bar and said side stay.

2. The joint of claim 1 wherein said fixing bore is threaded and said fixing means is a threaded bolt extending through said second bore and threaded into said fixing bore.

3. The joint of claim 2 wherein the face of said connecting piece opposite said one face includes a counterbore concentric with said second bore, said counterbore being of such a size that the head of said bolt may be at least partially immersed therein.

4. The joint of claim 1 wherein said channel section and said projecting portion are mutually tapered from said one face of said receptacle and connecting piece towards the faces of said channel section and projecting portion from which said bores extend.

* * * * *